United States Patent [19]

Eventoff

[11] 4,235,141

[45] Nov. 25, 1980

[54] ELECTRONIC APPARATUS

[76] Inventor: Franklin N. Eventoff, 2351 Lake View Ave., Los Angeles, Calif. 90039

[21] Appl. No.: 943,501

[22] Filed: Sep. 18, 1978

[51] Int. Cl.[3] ..... G10H 1/00; H01C 10/00

[52] U.S. Cl. ..... 84/1.01; 84/1.16; 84/DIG. 7; 84/1.24; 338/69

[58] Field of Search ..... 84/1.01, 1.08, 1.24, 84/DIG. 7, DIG. 20, 1.16; 338/69

[56] References Cited

U.S. PATENT DOCUMENTS

| | | | |
|---|---|---|---|
| 1,683,059 | 9/1928 | Deventer | 338/96 |
| 1,847,119 | 3/1932 | Lertes et al. | 331/106 |
| 2,141,231 | 12/1938 | Trautwein | 84/1 |
| 2,375,178 | 5/1945 | Ruben | 201/50 |
| 2,430,989 | 11/1947 | Miller | 201/48 |
| 2,510,792 | 6/1950 | Baker | 201/48 |
| 3,386,067 | 5/1968 | Costanzo | 338/100 |
| 3,624,583 | 11/1971 | Nakada | 338/69 |
| 3,624,584 | 11/1971 | Ohno | 338/69 |
| 3,626,350 | 12/1971 | Suzuki et al. | 84/DIG. 7 X |
| 3,662,641 | 5/1972 | Allen et al. | 84/1.01 |
| 3,776,087 | 12/1973 | Ogi | 84/1.24 |
| 3,960,044 | 6/1976 | Nagai et al. | 338/114 |
| 4,044,642 | 7/1977 | Pearlman et al. | 84/1.24 |
| 4,079,651 | 3/1978 | Matsui | 338/69 |
| 4,121,488 | 10/1978 | Akiyama | 84/DIG. 7 |

*Primary Examiner*—J. V. Truhe
*Assistant Examiner*—Forester W. Isen
*Attorney, Agent, or Firm*—Nilsson, Robbins, Dalgarn, Berliner, Carson & Wurst

[57] ABSTRACT

An apertured insulating strip permits closing a circuit only at contact points defined by the apertures between a low resistance conductor and a high resistance conductor in an electronic circuit of the type which produces musical notes each having a frequency dependent upon the resistance downstream of a particular contact point.

15 Claims, 6 Drawing Figures

FIG. 5
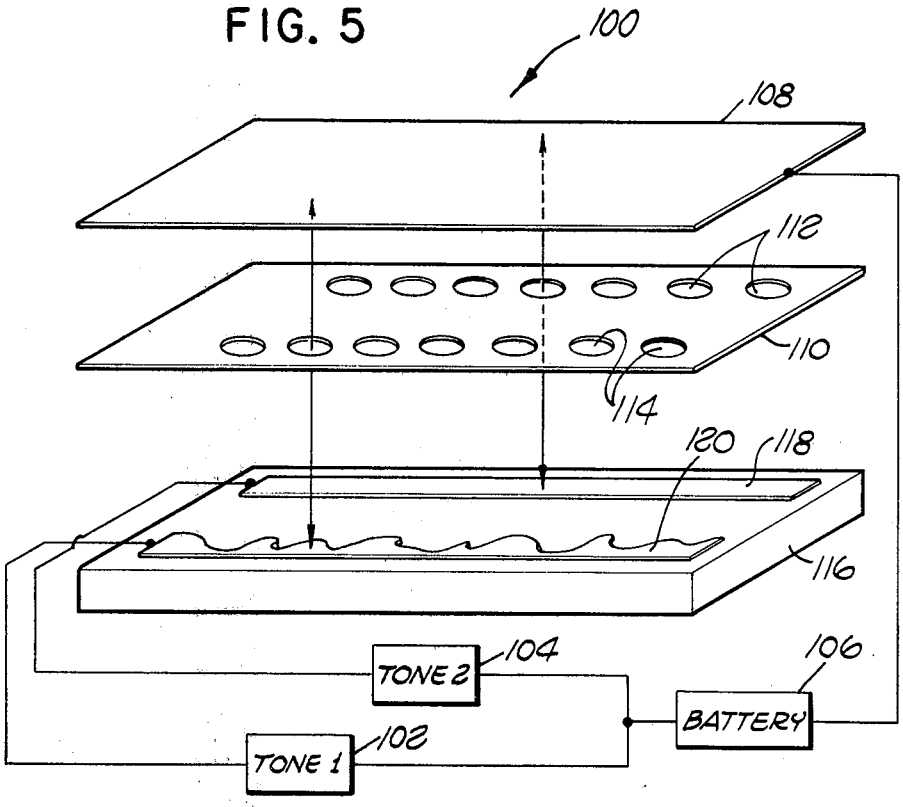
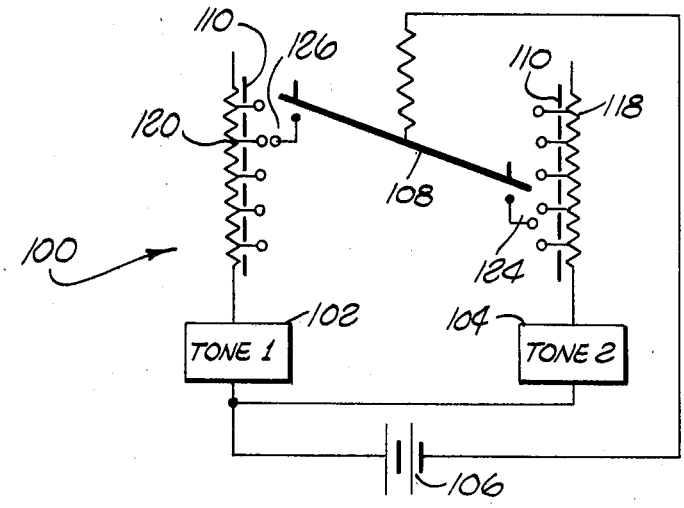
FIG. 6

ELECTRONIC APPARATUS

BACKGROUND OF THE INVENTION

The present invention relates to electronic musical apparatus and, in particular, to an apparatus and circuit which produces a tone having a frequency which is a function of the value of a resistance selected by an operator.

In the past, varying frequencies have been generated by a speaker as powered by an electronic circuit by varying one of the resistance values in the circuit. Various means have been provided for varying that resistance. For example, in some apparatus, pressure sensitive devices have been provided whereby the resistance increases and decreases as a physical pressure is exerted against the device. Two such pressure sensitive devices are disclosed in U.S. Pat. Nos. 2,375,178 and 3,386,067.

In U.S. Pat. No. 3,662,641, variable resistors were also used for tuning an electronic instrument. However, many such variable resistors were required, one for each frequency to be generated. Furthermore, the variable resistors were conventional potentiometers which were not used to select a frequency but rather to assure that a frequency selected by other means was correct and not flat or sharp.

Still another method of varying the resistance has been to provide discrete conductive frets along the neck of a musical instrument with the frets being electronically connected to a resistance ladder. In such an arrangement, an electrical connection at any fret causes a different resistance to be inserted into the circuit thus causing a different frequency to be generated by the instrument. However, such circuits are discrete in nature and require a number of individual discrete resistors connected in a ladder or series configuration and do not incorporate individual variable resistors.

By contrast, the present invention incorporates a single resistor strip for each tone to be simultaneously produced, the resistor strip having a continuous contact surface and a resistance value which is proportional to the length of the strip. The resistor strip is spaced apart from a conductor strip so that by depressing the conductor strip at an appropriate location, contact is made with the continuous contact surface of one or more of the resistor strips thereby inserting different values of resistance into one or more tone generating circuits. Each tone generating circuit generates a signal having a frequency which depends upon that resistance value.

In U.S. Pat. No. 3,626,350, filed February 17, 1970, by Suzuki, et al, a variable resistor device for electronic musical instruments was disclosed incorporating a plurality of strip-shaped resistor bodies formed on one surface of the base member with a resilient pressure contact member covering the resistor bodies. A plurality of mutually spaced apart strips of metal are mounted on the inner surface of the pressure contact member to confront the resistor bodies in spaced relationship. By continuously varying the point of contact between the resistor body and the metal strip, a Portamento chord is produced.

By contrast, the present invention utilizes only a single conductor strip which is spaced over one or more resistor strips in a continuous manner. In addition, the present invention utilizes an insulating fret strip positioned between the conductor strip and the one or more resistor strips to prevent contact between the conductor strip and a particular resistor strip even when the conductor strip is depressed. Discrete tones are then produced by the tone generating circuits by providing holes or spaces in the insulating fret strip so that electrical contact may be made only at discrete locations corresponding to the holes or spaces through the insulating fret strip. Of course, it will be appreciated that the insulating fret strip may be either a single insulating fret strip positioned over the one or more resistor strips or may be a plurality of insulating fret strips, one being provided for each resistor strip.

Thus, the above arrangement provides a simplified variable resistor device for an electrical musical instrument which produces a tone at discrete selected values of frequency.

In still another prior art Patent, No. 2,141,231, issued December 27, 1938, to Trautwein, there is disclosed an electrical musical instrument incorporating a continuous contact bar. However, no insulating fret strip is required or disclosed as a means of selecting the discrete frequencies to be generated by the tone generation circuits. In addition, the above patent incorporates substantially more complex circuitry than the present invention.

Various other related patents were found and cited in the prosecution of Patent No. 3,626,350 discussed above and include U.S. Pat. Nos. 1,847,119; 1,683,059; 2,430,989 and 2,510,792.

SUMMARY OF THE INVENTION

An electronic musical apparatus is provided having at least one tone generation means where each tone generation means has two electrical leads. A selective resistance means is provided by which a particular resistance value may be selected and connected between the first and the second leads of each tone generation means. More specifically, the selective resistance means has a variable resistor length with a contact means along that length associated with each tone generation means. The resistance value of each selective resistance means is a function of the length of the variable resistor. The variable resistor is coupled to the first lead. Means for selectively contacting the variable resistor along the length of the contact means is coupled to the second lead so that the selected resistance for each variable resistor is a function of the distance and physical configuration along the variable resistance between the two leads. Each tone generation means then generates a tone having a frequency which is a function of the resistance value selected and connected between the two leads of that tone generation means.

In the preferred embodiment, the selective resistance means is configured like a normally opened switch with means being provided for contacting the continuous contact length at any point along the length of a particular selective resistance means. The value of resistance inserted between the two leads of a selected tone generation means is then determined by the location along the continuous contact length at which an electrical contact is made.

In order to provide such a switching function, the selective resistance means preferably comprises at least one resistor strip having a continuous contact region along its length. Each resistor strip is chosen to have a resistance value which is proportional to the length of the resistor strip. One lead from a selected tone generation means is then attached to one end of a correspondingly selected resistor strip. A conductor strip is spaced adjacent to and along the length of all of the resistor strips in open circuit relationship and is coupled at one of its ends to the other leads from the plurality of tone generation means. Because each resistor strip has a continuous contact region along its entire length, the value of resistance can be selected by pressing the conductor strip against the selected resistor strip at a point along the length of the resistor strip. The conductor strip and each resistor strip are maintained in a normally opened switch configuration by spacers positioned between the resistor strips and the conductor strip.

The selective resistance, in addition to the resistor strips and the conductor strip, comprises an insulating fret strip positioned between each resistor strip and the conductor strip. The insulating fret strip preferably has a plurality of orifices or slots at selected discrete locations therealong for defining a discrete resistance value corresponding to each orifice or slot. The orifices are then positioned in a selected registration between the resistor strips and the conductor strip. Thus, the circuit will be closed, that is, the normally opened switch of each tone generation means will be closed, only when the conductor strip is pressed against a selected resistor strip at a location where the insulating fret strip has an orifice or slot allowing contact to be made therethrough. If the conductor strip is pressed against one of the resistor strips at a location other than where an orifice or slot occurs in the insulating fret strip, then no electrical contact will be made since such contact is prevented by the insulating fret strip. Thus, a finite number of frequency values will be provided for defining a scaled keyboard.

It will be appreciated that the insulating fret strip may be formed by masking regions of the conductor or resistor strip and then spraying an insulating substance in the unmasked regions.

An exterior fret indicator strip may also be positioned adjacent to and along the selective resistance means. The fret indicator strip has a plurality of indication regions where each region is aligned along the selective resistance means to indicate which tone will be produced by the tone generation means when the fret indicator strip is pressed at a particular indication region. The means of indicating a frequency may be by numbering or color coding the fret indicator strip.

In the preferred embodiment, the tone generation means comprises a speaker, an oscillator circuit coupled to the speaker and coupled between the first and the second leads coupled across the selective resistance means. A power supply means for supplying electrical power to the tone generation means is also provided. The tone generation means in general produces a frequency which is proportional to the value of the resistance coupled between the two leads from the tone generation means.

BRIEF DESCRIPTION OF THE DRAWINGS

The invention will be better understood from the detailed description below taken in conjunction with the drawings wherein like reference characters refer to like parts throughout and in which:

FIG. 5 is a partial schematic of the present invention having two tone generation circuits for generating two tones simultaneously where an exploded view of the particular variable resisting means is shown; and FIG. 6 is a schematic illustrative of the particular circuit of FIG. 5.

DETAILED DESCRIPTION

Figure 1:
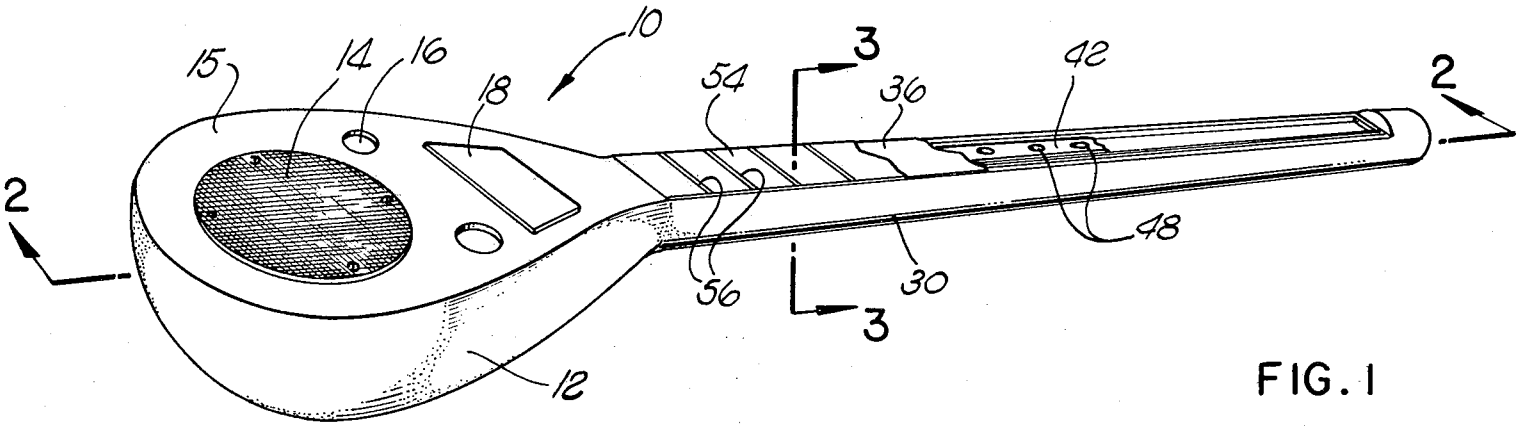
FIG. 1 is a perspective view of the present invention with a cutaway neck illustrating the various component parts of the invention.

Referring first to FIG. 1, there is shown an electronic musical instrument 10 in accordance with the present invention having a sound box 12 coupled to a neck portion 30. In one embodiment, the sound box 12 is generally hollow having a half-spherical or oval shape with a substantially flat top surface 15. Positioned on the flat top surface 15 may be a speaker cover 14 and one or more tone holes 16 which extend through the flat top surface 15 into the interior of the sound box 12. Also provided in the top surface is a battery cover 18 underneath which is provided a holder 58 for a battery 60 (see FIG. 2).

Along the top of the neck 30 is a fret indicator strip 54 having a plurality of fret indicators 56 positioned at selected locations along the neck to indicate the portion along the neck at which an operator may press to produce a tone of a given frequency. The fret indicators may be numbered or color coded to indicate the note or frequency which will be provided. Although the discussion of FIGS. 1 through 4 makes particular reference to a single resistor strip, it will be appreciated that a plurality of resistor strips and associated tone generation circuits may be implemented without departing from the present invention.

A cut-away section view of the neck 30 of the present invention is illustrated in FIG. 1 showing the fret indicator strip 54, which may be made of plastic or any other material, on which the fret indicators 56 are positioned. Adjacent to the fret indicator strip and underneath it is a flexible conductor strip 36 which is substantially nonresistive in character. The flexible conductor strip 36 is spaced above a first resistor strip 34 having an upper variable resistive surface 66. An insulating fret strip 42 having fret spaces or orifices 48 is positioned between the resistor strip 34 and the flexible conductor strip 36. It will be appreciated that the insulating fret strip 42 or separate spaces may be used to space the strips apart in a normally open configuration.

Figure 2:
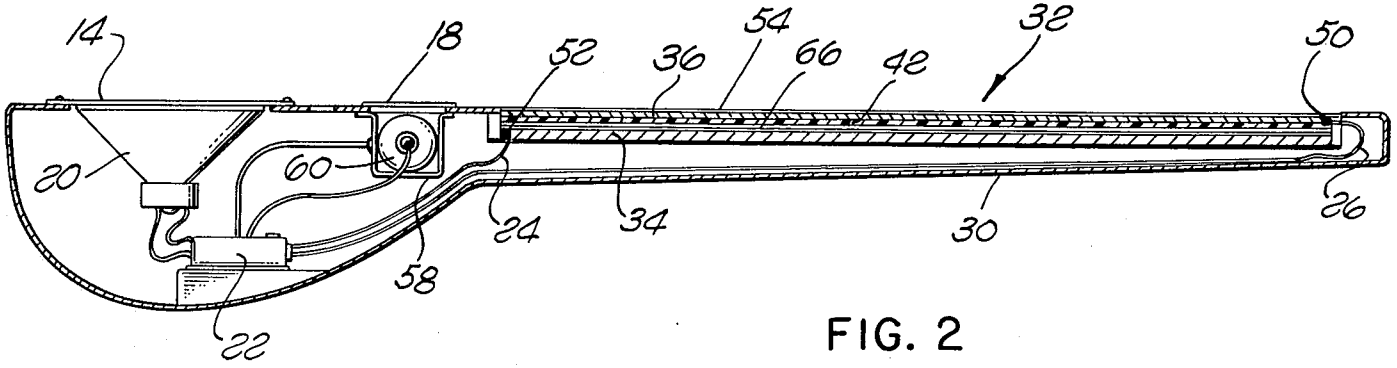
FIG. 2 is a side plan view through the section 2—2 of FIG. 1.

Referring now to FIG. 2, there is shown a cross-section of the present invention through the section 2—2 of FIG. 1 in which the sound box 12 is shown containing tone generation means comprising a tone circuit 22, the battery 60 and a speaker 20. The speaker 20 is positioned below the speaker cover 14 and the battery 60 is positioned in the holder 58 below the battery cover 18. Of course any other convenient arrangement of the components of the tone generation means may be provided in accordance with the invention.

Figure 3:
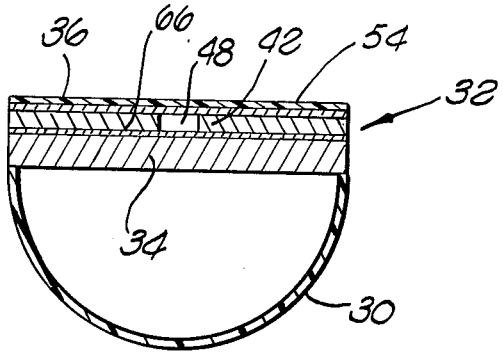
FIG. 3 is an end plan view through the section 3—3 of FIG. 1.

Referring to FIG. 3, which is a cross-section detail of the selective resistance means of the present invention through section 3—3 of FIG. 1, in conjunction with the section shown in FIG. 2, a selective resistance means 32 is shown comprising a generally rigid resistor strip 34 having the resistive surface layer 66 positioned along the length of the neck 30. The resistor strip 34 has a resistance along the resistive surface layer 66 which is dependent upon not only the length but the width and shape of the path between the two points of contact between which current travels along the resistive surface layer 66. One end 52 of the resistive surface 66 of the resistor strip 34 is coupled by a lead 24 to the tone circuit 22. Positioned above the resistive surface 66 of the resistor strip 34 is the conductor strip 36 along which there is little or no resistance.

In the preferred embodiment of the present invention, the conductor strip 36 is preferably flexible and is spaced above the resistor strip 34 so that the conductor strip 36 and the resistive surface 66 of the resistor strip 34 are not in contact so as to act as a switch in a normally open configuration.

Coupled to one end 50 of the conductor strip 36 is a second lead 26 also coupled to the tone circuit 22. Thus, when the conductor strip 36 is depressed to come in contact with the resistive surface, i.e., the continuous contact length 66 of the resistor strip 34, the "switch" is effectively closed activating the tone circuit 22. The tone circuit 22 then generates a frequency to activate speaker 20 to produce the sound having that frequency. The particular frequency generated by the tone circuit 22 is dependent upon the resistance between the first lead 24 and the second lead 26. Since the resistance of the resistive surface 66 of the resistor strip 34 varies dependent upon the length and width of the resistive surface along which the current travels, different resistance values can be defined between the first lead 24 and the second lead 26 by depressing the conductor strip 34 at varying locations thereby closing the "switch". It will also be appreciated, that the particular shape and size of the sensitive surface 66 will also effect the resistance.

In one embodiment, the insulating strip 42 may be placed in the space between the conductor strip 36 and the resistor strip 34. The insulating strip may also be provided with fret spaces or orifices 48 (see FIG. 1) therealong so that an electrical contact will be made only through one of the orifices in the insulating strip 42. Thus, the present invention may, in one configuration, have a continuous tone scale with an infinite number of possible frequencies generated or, in another embodiment, may incorporate an insulating strip with a finite number of fret spaces defining a discrete, finite number of frequencies which the tone circuit 22 can make.

Referring particularly to FIG. 3, the spaced relationship between the conductor strip 36 and the resistor spacers extending along the length and on either side of the resistor strip 34 or by the insulating fret strip 42 itself. It will be appreciated that the size of the holes and the thickness of the fret strip 42 will affect the amount of pressure required to produce a tone. The conductor strip 36 may then be placed on top of the insulating fret strip 42. Consequently, carving, masking, trimming or etching the resistive material comprising the resistive surface 66 will also effect the value of resistance. The fret indicator 54 may be placed along the top of the conductor strip 36 to indicate where the conductor strip 36 must be depressed to produce a particular frequency. Unlike the insulating fret strip 42 previously discussed, the fret indicator strip 54 does not alter the electrical operation of the apparatus but simply indicates at which point the conductor strip 36 must be depressed to make contact and produce a tone having a particular frequency. In the construction of the present apparatus, it will, of course, be appreciated that the fret indicator strip 54, as well as the insulating fret strip 42, must be aligned along the resistor strip 34 so as to produce the indicated tone frequencies in the tone circuit 22.

Figure 4:
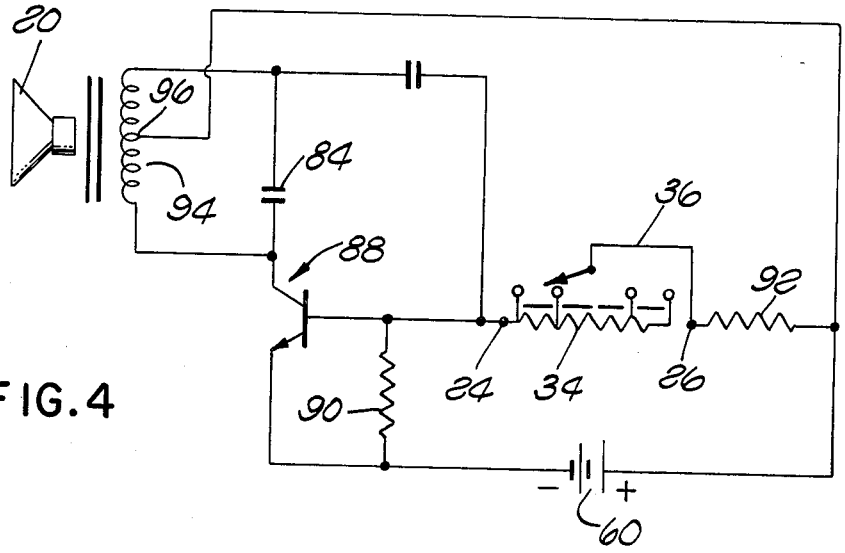
FIG. 4 is an oscillator circuit which may be utilized in the present invention to produce a frequency which is depended upon the resistance value of the selective resistance means.

Referring now to FIG. 4, an illustrative circuit for producing the tone is shown in which a resistor strip 34 is attached to the lead 24 with the other end being opened and the lead 26 attached to the conductor strip 36 which may make contact at any point along a continuous contact length 66 (FIG. 22) of the resistor strip 34.

In one embodiment, the maximum resistance of the resistor strip 34 is 50 K. Coupled between the conductor strip 36 and the positive terminal of the battery 60 is a resistor which in the illustrative embodiment is 15 K. The lead 24, coupled to one end of the resistor strip 34, is coupled to the base of a transistor 88 which may be an NPN 3904. The emitter of the transistor 88 is then coupled to the negative terminal of the battery 60 with a 4.7 megaohm resistor 90 connected between the base of the transistor 88 and the emitter of the transistor 88. The collector of the transistor 88 is then coupled to one terminal of a center tap speaker transformer coil 94 whose other end is coupled through a 0.05 microfarad capacitor 86 to the base of the transistor 88. Coupled between the two end terminals of the speaker transformer 94 is a second capacitor 84 which in the embodiment shown has a value 0.1 microfarads. As previously indicated, the speaker transformer coil 94 has a center tap 96 which is coupled to the positive terminal of the battery 60.

In operation, the junction between the conductor strip and the continuous contact length 66 acts as a switch in the normally opened configuration thus preventing any power from the battery 60 from being supplied to the circuit. Consequently, no frequency is produced by the speaker 20. When the flexible conductor strip 36 is depressed to make contact at some point along the continuous contact length 66 of the resistor strip 34, the circuit is completed with a portion of the resistance in the resistor strip 34 being inserted into the circuit. A frequency is thus generated by the circuit and produced as sound by the speaker 20. A particular advantageous feature of the open circuit relationship of the invention at this point is that the circuit uses no current while not being played thus conserving power from the batteries or other power source.

Although a specific circuit has been described in conjunction with FIG. 4, it will be appreciated that any circuit which produces a tone whose frequency depends upon a resistance inserted by a selective resistance means may be used without departing from the spirit of the present invention.

In summary then, the present invention comprises an electronic musical instrument 10 having a housing 12 to which a neck 30 is connected. The neck 30 includes a first end connected to the housing 12 and a second free end. As shown in FIG. 2, an electric oscillator circuit 22 is mounted in the housing 12 and is connected to a loudspeaker 20 and a variable resistor assembly 32 takes the form of a long strip consisting of one or more layers of flexible material affixed to the top of and extending along the length of the neck 30.

More specifically, as shown in FIG. 3, the variable resistor assembly 32 includes a first plastic layer 54 having an upper surface carrying indicia 56 (FIG. 1) representing notes in a musical scale. A second flexible strip 36 is also provided to be essentially conductive and thus may be impregnated with a low resistance, electrically conducting material. The variable resistor 32 may also include a strip of insulating material 42 which is provided with apertures 48 (see FIG. 1). Finally, the variable resistor assembly 32 has a lower layer 34 which may be of a thin plastic material with its lower surface affixed to the neck 30 and its upper surface 66 provided with a resistive material. One end of the low resistance conductor 36 is electrically connected, at one of its ends to one lead from the oscillator circuit 22 and the high resistance surface 66 is electrically connected at one of its ends to the other lead from the oscillator circuit 22. Therefore, when indicia 56 is depressed, the low resistance conductor 36 extends through one of the apertures 48 into engagement with the high resistance conductor 34 closing a circuit having an effective resistance for producing a musical note associated with one of the indicia 56.

A two-tone embodiment of the present invention whereby two tones may be simultaneously generated is illustrated in FIG. 5. In FIG. 5, the selective resisting means 100 thus comprises a supporting base member 116 on which is placed a first resistor strip 118 and a second resistor strip 120. A conductor strip 108 is positioned in spaced, open circuit, configuration above the resistor strip 118 and the resistor strip 120 utilizing separate spacers (not shown) or may be spaced apart by an insulating strip 110. An insulating strip 110 is positioned between the conductor strip 108 and the resistor strips 118 and 120. The insulator fret strip 110 has a plurality of orifices 112 in perpendicular alignment or registration between the first resistor strip 118 and the conductor strip 108, and further has a plurality of second orifices 114 positioned in perpendicular registration between the second resistor strip 120 and the conductor strip 108. As previously discussed, the particular location of the various orifices 112 and 114 along the length of the resistor strips 118 and 120 are selected so that tone generation circuits 104 and 102 will generate desired frequencies when in contact between the resistor strip 118 or 120 and the conductor strip 108 is made through one of the orifices 112 and one of the orifices 114.

In order to properly connect the selective resisting means 100 to appropriate circuits, the conductor strip 108 is coupled to one side of a battery 106 with the opposite side of a battery connected to the plurality of second leads from the tone generation circuit 102 and tone generation circuit 104. The other lead of the tone generation circuit 102 is then coupled to one end of the second resistor means 120 with the other lead from the tone generation circuit 104 coupled to one end of the first resistor strip 118. Of course, it will be appreciated that any number of resistor strips and tone circuits may be utilized without departing from the spirit of the present invention.

Referring now to FIG. 6, a generalized schematic of the circuitry of the musical instrument of the present invention is shown in which a battery 106 is coupled to one lead from the tone generation circuit 102 and one lead from the tone generation circuit 104 with the opposite lead from the battery 106 coupled to the conductor strip 108. The conductor strip 108 is then positioned in open switch configuration above both the first variable resistor strip 118 and the second variable resistor strip 120 where contact between the conductor strip 108 and the particular resistor strips is made only at the location of the orifices in the insulating strip 110. One end of the resistor strip 118 is then coupled to the other lead from the tone generation circuit 104 and one lead from the resistor strip 120 is coupled to the other lead from the tone generation circuit 102. It will be appreciated that the resistive surfaces 118 and 120 may have varying widths, surface areas, shapes, lengths or other physical configurations as illustrated to obtain a proper resistance value when contact through an orifice in the insulator strip 110 is made.

It will be appreciated that various other modifications and changes may be made without departing from the present invention. For example, the location of the resistor and conductor strips may be interchanged. Consequently, the above-identified details are to be taken in an illustrative sense and not in a limiting one.

What is claimed is:

1. In combination with a variable resistor for controlling the operation of an electronic musical instrument including a tone generator for generating musical notes each having a frequency dependent upon the amount of resistance in an electrical circuit connecting the variable resistor to the tone generator, said variable resistor including low resistance and high resistance conductor strings disposed along their lengths in open circuit relationship, the improvement which comprises:

an apertured but otherwise solid strip of insulating material electrically insulating said low and high resistance conductor strips from each other and defining a plurality of selected discrete open locations spaced from each other lengthwise along said high resistance conductor strip corresponding to the amount of resistance required to produce predetermined musical notes, said apertures being so spaced whereby to limit electrical contact between said strips to said discrete locations.

2. An electronic musical apparatus comprising:

first means for generating musical notes having frequencies dependent upon the amount of resistance in electrical circuit connected to said first means;

first and second electrical leads connected to said electrical circuit; and second means for inserting said resistance into said circuit between said first and second leads, comprising:

a resistor strip connected to said first lead;

a conductor strip connected to said second lead;

third means for maintaining said resistor strip and said conductor strip disposed along their lengths in open circuit relationship, the amount of resistance in said electrical circuit being dependent upon the location at which electrical contact is made between said resistor strip and said conductor strip along the length of said resistor strip; and an apertured but otherwise solid strip of insulating material electrically insulating said resistor strip from said conductor strip defining a plurality of selected discrete open locations spaced from each other lengthwise along said resistor strip corresponding to the amount of resistance needed for producing a plurality of predetermined musical notes whereby to limit electrical contact between said strips to said discrete locations.

3. An electronic musical apparatus comprising:

at least one tone generation means having a first lead and a second lead; and a selective resistance means adapted for selecting and inserting a resistance between each of the first and second leads, the selective resistance means comprising:

at least one resistor strip connected at one of its ends to said first lead, a conductor strip spaced adjacent to and along the length of the resistor strip in open circuit relationship, the conductor strip coupled at one of its ends to said second lead, the value of the resistance of said resistor strip being variable dependent upon the location at which electrical contact between said resistor strip and the conductor strip is made along the length of the resistor strip, and an apertured but otherwise solid strip of insulating material positioned to electrically insulate said strips from each other and defining a plurality of selected discrete open locations spaced lengthwise from each other for controlling the locations at which said electrical contact may be made along the length of said resistor strip by limiting electrical contact between said strips to said discrete locations.

4. The electronic musical apparatus of claim 3 wherein the selective resistance means further comprises spacer means positioned between the resistor strip and the conductor strip for providing the normally open circuit relationship.

5. The electronic musical apparatus of claim 3 further comprising an external fret indicator strip positioned adjacent to and along the selective resistance means, the fret indicator strip having a plurality of indication regions, each indication region being aligned with means positioned between the strips for indicating at least one location along the selective resistance means at which a selected tone will be generated by one of the tone generation means when that location is depressed causing the conductor strip and one of the resistor strips to come into electrical contact.

6. The electronic musical apparatus of claim 3 wherein each tone generation means comprises:

a speaker;

an oscillator circuit coupled to the speaker and coupled between the first lead and the second lead for generating a tone; and power supply means for supplying electrical power to the tone generation means.

7. An electronic musical apparatus comprising:

a plurality of tone generation means each having a first lead and a second lead;

a selective resistance means for selecting and inserting a resistance between the first and second leads, the selective resistance means comprising at least on resistor strip having a resistance value dependent upon its physical configuration and connected at one of its ends to the first lead from one of the tone generation means, and a conductor strip spaced adjacent to and along the length of the resistor strip in open circuit relationship, the conductor strip coupled at one of its ends to the second lead from all the tone generation means, the value of the resistance for a particular tone generation means defined by electrically contacting the resistor strip coupled to the particular tone generation means and the conductor strip at a selected point along the length of the particularly coupled resistor strip and an insulated fret strip formed of an apertured but otherwise solid strip of insulating material positioned to electrically insulate the resistor strips from the conductor strip the insulated fret strip having a plurality of orifices, each orifice positioned at a selected discrete location therealong for defining a discrete electrical contacting point at the location of the orifice whereby to limit electrical contact between said resistance and conductor strips to said discrete locations.

8. An electronic musical apparatus comprising:

a plurality of tone generation means each having a first lead and a second lead; and variable resistance means coupled between the first and second leads comprising:

at least one first conducting means having a resistance gradient along its length, second conducting means positioned adjacent to and along the first conducting means in spaced apart relationship, means for electrically contacting at least a selected one of the first conducting means and second conducting means at a selected point along the length of the selected first conducting means for connecting a portion of the first conducting means between one of the first and second leads for defining a resistance value for one of the tone generation means, each tone generation means adapted for generating a tone having a frequency dependent upon the value of the defined resistance connected thereto, and an insulating fret strip formed of an apertured but otherwise solid strip of insulating material positioned to electrically insulate the first and second conducting means from each other, the insulating fret strip having a plurality of orifices at selected discrete locations therealong for defining discrete electrical contacting points at the locations of the orifices whereby to limit electrical contact between said resistance and conductor strips to said discrete locations.

9. A device for producing a series of discrete electrical outputs comprising low resistance and high resistance conductor materials and an apertured but otherwise solid strip of insulating material positioned to electrically insulate said conductor materials from each other and defining a plurality of selected discrete open locations spaced from each other to limit electrical contact between said conductor materials to said discrete locations for providing said electrical outputs in correspondence to said selected locations.

10. An apparatus comprising:

first means for generating electrical outputs having frequencies dependent upon the amount of resistance in an electrical circuit connected to said first means;

first and second electrical leads connected to said electrical circuit; and second means for inserting said resistance into said circuit between said first and second leads, comprising:

a resistor strip connected to said first lead;

a conductor strip connected to said second lead;

third means for maintaining said resistor strip and said conductor strip disposed along their lengths in open circuit relationship, the amount of resistance in said electrical circuit being dependent upon the location at which electrical contact is made between said resistor strip and said conductor strip along the length of said resistor strip and an apertured but otherwise solid strip of insulating material positioned to electrically insulate said resistor strip from said conductor strip and defining a plurality of selected discrete open locations spaced from each other along said resistor strip corresponding to the amount of resistance needed for producing a plurality of predetermined electrical outputs whereby to limit said electrical contact between said strips to said discrete locations.

11. An apparatus comprising:

at least one electrically actuable device having a first lead and a second lead; and a selective resistance means adapted for selecting and inserting a resistance between each of the first and second leads, the selective resistance means comprising:

at least one resistor strip connected at one of its ends to said first lead, a conductor strip spaced adjacent to and along the length of the resistor strip in open circuit relationship, the conductor strip coupled at one of its ends to said second lead, the value of the resistance of said resistor strip being variable dependent upon the location at which point contact between said resistor and the conductor strip is made along the length of the resistor strip, and an apertured but otherwise solid strip of insulating material positioned to electrically insulate said strips from each other and defining a plurality of selected discrete open locations spaced lengthwise from each other for controlling the locations at which said point contact may be made along the length of said resistor strip by limiting electrical contact between said strips to said discrete locations.

12. The apparatus of claim 11 wherein the selective resistance means further comprises spacer means positioned between resistor strip and the conductor strip for providing the normally open circuit relationship.

13. An apparatus comprising:

a plurality of electrically actuable devices, each having a first lead and a second lead;

a selective resistance means for selecting and inserting a resistance between the first and second leads, the selective resistance means comprising at least one resistor strip having a resistance value dependent upon its physical configuration and connected at one of its ends to the first lead from one of the electrically actuable devices, and a conductor strip spaced adjacent to and along the length of the resistor strip in open circuit relationship, the conductor strip coupled at one of its ends to the second lead from all the electrically actuable devices, the value of the resistance for a particular tone generation means defined by electrically contacting the resistor strip coupled to the particular electrically actuable device and the conductor strip at a selected point along the length of the particularly coupled resistor strip; and an insulated fret strip formed of an apertured but otherwise solid strip of insulating material positioned to electrically insulate the resistor strips from the conductor strip, the insulated fret strip having a plurality of orifices, each orifice positioned at a selected discrete location therealong for defining a discrete electrical contacting point at the location of the orifice whereby to limit electrical contact between said resistance and conductor strips to said discrete locations.

14. The improvement of claim 1 in which said low resistance and high resistance conductor strips are juxtaposed along their lengths and in which said electrical contact at said discrete locations is obtained by direct mechanical contact at said discrete locations between said low resistance and high resistance conductor strips.

15. The apparatus of any of claims 2–13 in which said low resistance and high resistance conductor strips are juxtaposed along their lengths and in which said electrical contact at said discrete locations is obtained by direct mechanical contact at said discrete locations between said low resistance and high resistance conductor strips.

* * * * *

UNITED STATES PATENT AND TRADEMARK OFFICE

CERTIFICATE OF CORRECTION

PATENT NO. : 4,235,141

DATED : November 25, 1980

INVENTOR(S) : Frank N. Eventoff

It is certified that error appears in the above-identified patent and that said Letters Patent are hereby corrected as shown below:

Claim 1:

Column 8, line 22, delete "strings" and substitute --strips--.

Signed and Sealed this

*Nineteenth* Day of *March 1985*

[SEAL]

*Attest:*

DONALD J. QUIGG

*Attesting Officer* *Acting Commissioner of Patents and Trademarks*